United States Patent [19]

Raistakka

[11] 4,079,939

[45] Mar. 21, 1978

[54] VARIABLE ORIENTATION MULTIPLE HOOP GAME TARGET

[76] Inventor: John E. Raistakka, 1318 SW. 12th Ave., Portland, Oreg. 97201

[21] Appl. No.: 749,045

[22] Filed: Dec. 9, 1976

[51] Int. Cl.[2] ..... A63B 71/00

[52] U.S. Cl. ..... 273/105 R

[58] Field of Search ..... 273/26 A, 95 R, 95 H, 273/105 R, 102 R, 102 S; 40/125 H, 20 R, 20 A

[56] References Cited

U.S. PATENT DOCUMENTS

| | | | |
|---|---|---|---|
| 906,392 | 12/1908 | Dietz | 273/102 R |
| 1,249,716 | 12/1917 | Calder | 273/95 R |
| 1,393,408 | 10/1921 | Tenney | 273/95 R |
| 1,598,865 | 9/1926 | Limerick | 273/95 R |
| 2,008,359 | 7/1935 | Lamb | 273/95 R |
| 3,296,725 | 1/1967 | Fenwick | 40/125 H X |
| 3,752,476 | 8/1973 | Mahoney | 273/26 A X |

FOREIGN PATENT DOCUMENTS

| | | | |
|---|---|---|---|
| 56,081 | 10/1921 | Sweden | 273/102 R |

OTHER PUBLICATIONS

Playthings; vol. 56, No. 6; June, 1958; p. 16.

*Primary Examiner*—Richard C. Pinkham
*Assistant Examiner*—Vance Y. Hum
*Attorney, Agent, or Firm*—James D. Givnan, Jr.

[57] ABSTRACT

A game target including multiple hoop members in stacked relationship with one another with mortise and tenon components which permit various interconnecting hoop attachments. The mortise and tenon components enable simple assembly of the hoop members in a detachable manner enabling compact stowage and shipping of the target. The joint provided additionally allows the hoop members to be positioned so as to face in the same or different directions.

1 Claim, 7 Drawing Figures

VARIABLE ORIENTATION MULTIPLE HOOP GAME TARGET

BACKGROUND OF THE INVENTION

The present target is intended for use in several different types of throwing games using a ball, saucer shaped article or other thrown object and is somewhat in the general nature of the target shown in my co-pending U.S. application, Ser. No. 666,870, filed Mar. 15, 1976.

SUMMARY OF THE PRESENT INVENTION

The present invention is embodied within a target for throwing games wherein a pair of circular targets or hoops are provided with a socket arrangement therebetween provided for hoop adjustment and convenient target disassembly.

The target structure includes a base equipped stand having a tubular post within the upper end of which is supported a first hoop member which supports a socket attachment within which is inserted a tenon secured in place by a setscrew or the like. The tenon is associated with an upper hoop member which may be of tubular construction.

Important objects of the present target include the provision of a target structure having stacked hoops each of which may face at right angles to the other and are interconnected by a joint enabling ready detachment of the hoops for compact stowage or shipping of the target; the provision of a target structure of sturdy construction wherein a joint intermediate its hoop members interconnects same in a positive yet adjustable manner to provide a durable target not susceptible to damage by various thrown objects; the provision of a target having a mortise and tenon type joint interconnecting the hoop members in an adjustable manner to permit variations in the relationship of one hoop to another.

DETAILED DESCRIPTION OF THE PREFERRED EMBODIMENTS

Figure 2:
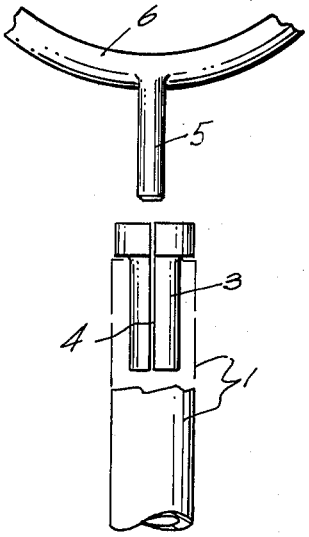
FIG. 2 is an enlarged detailed view of the post upper end with a resilient sleeve therein and with a lowermost hoop fragment spaced therefrom.
Figure 1:
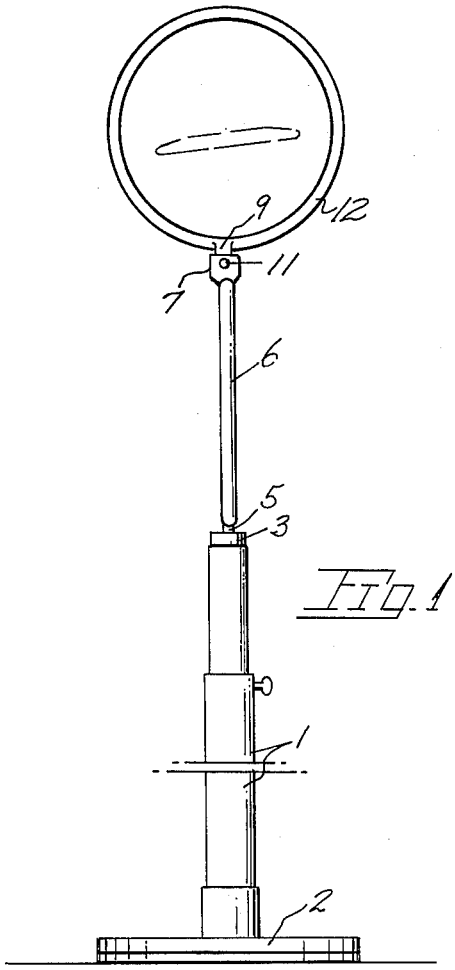
FIG. 1 is a front elevational view of the target with the post thereof sectioned for purposes of convenient illustration.
Figure 7:
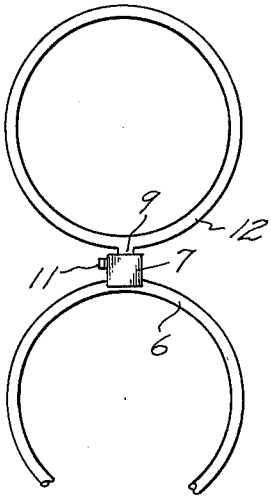
FIG. 7 is a side elevational, fragmentary view of repositioned hoop structures.

With continuing reference to the accompanying drawing wherein applied reference numerals indicate parts similarly identified in the following specification, the reference numeral 1 indicates a tubular post supported by a base 2 of an adequate size and weight to provide target stability. Post 1 may be of an adjustable, telescopic nature to permit vertical positioning of the following described hoops.

Disposed within the upper end of post structure 1 is a resilient sleeve 3 desirably bifurcated at 4 to facilitate friction tight reception of a projection 5 depending from a lower hoop structure 6. Sleeve 3 is preferably of neoprene rubber which securely confines projection 5 against excessive lateral movement. Accordingly, lower hoop 6 may both be both manually inserted and disengaged from its supporting post.

Figure 3:
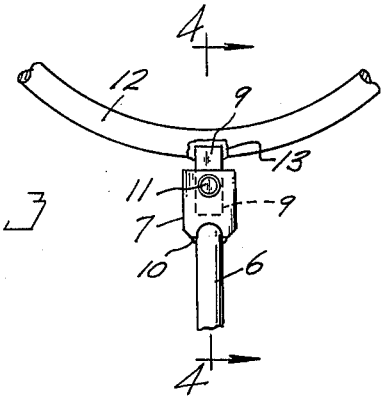
FIG. 3 is an enlarged detailed view of the upper and lower hoop fragments as viewed in FIG. 1 with an interconnecting joint.
Figure 4:
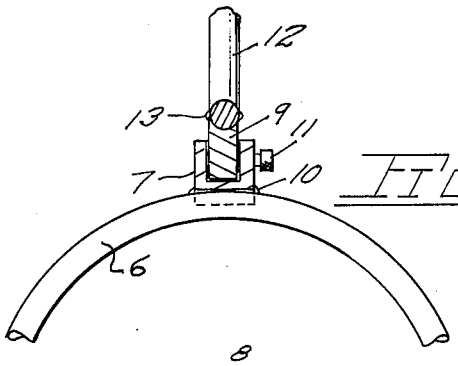
FIG. 4 is a sectional view taken along line 4—4 of FIG. 3 showing details of joint construction.
Figure 5:
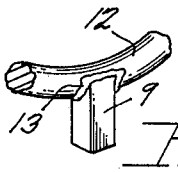
FIGS. 5 and 6 are respective views of tenon and mortise joint components removed from associated structure.
Figure 6:
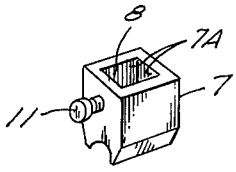

As best viewed in FIGS. 3, 4 and 6, a mortise member at 7 has multiple walls 7A which define an upwardly opening socket 8 for the inserted reception of a correspondingly shaped tenon at 9. A weld at 10 secures the mortise member in place on hoop 6 while a setscrew at 11 therein may be advanced inwardly to bear lockably against inserted tenon 9 which depends from an upper hoop structure at 12. A weld 13 secures tenon 9 to the upper hoop.

The hoop structure may be formed from rod material bent to an oval or round shape. The polygonal mortise and tenon type joint permit the players to orientate the hoop sturctures as desired to face in the same or perpendicular directions. While only two hoop structures are shown it will be understood that any number of stacked hoop structures may be utilized each facing in the same or different directions to accommodate the number of players positioned about the target structure. Similarly, the mortise and tenon components may be of other configuration, as for example, hexagonal in section to permit a wide variety of hoop disposition.

While I have shown but one embodiment of the invention it will be apparent to those skilled in the art that the invention may be embodied still otherwise without departing from the spirit and scope of the invention claimed.

Having thus described the invention what is desired to be secured under a Letters Patent is:

1. A game target for use in conjunction with a thrown article, said target comprising adjacent upper and lower hoop members having aligned vertical axes, said lower hoop member having a downwardly extending projection thereon for insertable engagement with a supporting post, a polygonal mortise and tenon joint carried by adjacent segments of said hoop members and interconnecting same in a detachable manner and permitting removal and reorientation of the upper hoop member by movement of same about its vertical axis.

* * * * *